US007775853B2

(12) United States Patent
Jeong et al.

(10) Patent No.: US 7,775,853 B2
(45) Date of Patent: Aug. 17, 2010

(54) CONFIGURABLE POLISHING APPARATUS

(75) Inventors: In-Kwon Jeong, Cupertino, CA (US); David E. Berkstresser, Los Gatos, CA (US)

(73) Assignee: KoMiCo Technology, Inc., Austin, TX (US)

( * ) Notice: Subject to any disclaimer, the term of this patent is extended or adjusted under 35 U.S.C. 154(b) by 453 days.

(21) Appl. No.: 11/762,007

(22) Filed: Jun. 12, 2007

(65) Prior Publication Data

US 2008/0051014 A1 Feb. 28, 2008

Related U.S. Application Data

(60) Provisional application No. 60/813,498, filed on Jun. 14, 2006, provisional application No. 60/830,472, filed on Jul. 13, 2006, provisional application No. 60/844,578, filed on Sep. 13, 2006.

(51) Int. Cl.
*B24B 49/00* (2006.01)
*B24B 51/00* (2006.01)

(52) U.S. Cl. ..... 451/8; 451/11; 451/66; 451/72; 451/339

(58) Field of Classification Search ..... 451/5, 451/8, 11, 285–290, 331, 339, 72, 66
See application file for complete search history.

(56) References Cited

U.S. PATENT DOCUMENTS

| | | | | |
|---|---|---|---|---|
| 6,575,816 | B2 * | 6/2003 | Hempel et al. | 451/41 |
| 6,916,231 | B2 * | 7/2005 | Wakabayashi | 451/66 |
| 6,949,177 | B2 * | 9/2005 | Jeong | 205/80 |
| 7,223,153 | B2 * | 5/2007 | Jeong | 451/11 |
| 7,273,408 | B2 * | 9/2007 | Chen et al. | 451/11 |
| 2007/0060023 | A1 * | 3/2007 | Jeong | 451/5 |
| 2007/0141954 | A1 * | 6/2007 | Chen et al. | 451/11 |
| 2007/0212976 | A1 * | 9/2007 | McReynolds et al. | 451/5 |

* cited by examiner

*Primary Examiner*—Timothy V Eley
(74) *Attorney, Agent, or Firm*—Thomas H. Ham; Wilson & Ham

(57) ABSTRACT

A polishing apparatus for polishing semiconductor wafers comprises a main polishing structure, which includes a plurality of polishing tables, a plurality of polishing heads and a plurality of load-and-unload stations, and an add-on polishing structure, which includes an additional polishing table and an additional polishing head. The add-on polishing structure can be attached to the main polishing structure to form a larger polishing structure with the additional polishing table and the additional polishing head.

28 Claims, 8 Drawing Sheets

CONFIGURABLE POLISHING APPARATUS

CROSS REFERENCE TO RELATED APPLICATION

This application is entitled to the benefit of U.S. Provisional Patent Application Ser. Nos. 60/813,498, filed on Jun. 14, 2006, 60/830,472, filed on Jul. 13, 2006, and 60/844,578, filed on Sep. 13, 2006, which are incorporated herein by reference.

FIELD OF THE INVENTION

The invention relates generally to semiconductor processing equipments, and more particularly to a polishing apparatus.

BACKGROUND OF THE INVENTION

Chemical mechanical polishing (CMP) process is widely used for planarization during fabrication of semiconductor devices. In general, CMP process involves polishing a surface of a semiconductor wafer on a polishing surface, e.g., a polishing pad, using a solution, e.g., a slurry solution, supplied between the wafer surface and the polishing surface. Depending on the CMP process, multiple CMP steps may be performed to produce a single planarized layer on the semiconductor wafer. As an example, multiple CMP steps may be performed during fabrication of a semiconductor device with copper damascene structures.

In order to facilitate multi-step CMP processes, CMP equipments with multiple polishing stations have been developed. A concern with conventional CMP equipments is that each CMP equipment can only perform specific multi-step CMP processes, which depends on the number of polishing stations of that CMP equipment. For example, a CMP equipment with two serially arranged polishing stations, which is designed for two-step serial CMP processes, cannot perform three-step serial CMP processes.

In view of this concern, what is needed is a polishing apparatus that can perform different multi-step CMP processes.

SUMMARY OF THE INVENTION

A polishing apparatus for polishing semiconductor wafers in accordance with an embodiment of the invention comprises a main polishing structure, which includes a plurality of polishing tables, a plurality of polishing heads and a plurality of load-and-unload stations, and an add-on polishing structure, which includes an additional polishing table and an additional polishing head. The add-on polishing structure can be attached to the main polishing structure to form a larger polishing structure with the additional polishing table and the additional polishing head.

A polishing apparatus for polishing semiconductor wafers in accordance with an embodiment of the invention comprises a main polishing structure and an add-on polishing structure. The main polishing structure includes a plurality of polishing tables, a plurality of polishing heads and a plurality of load-and-unload stations that are operatively coupled to a main frame structure. The polishing heads are operatively coupled to the main frame structure such that each of the polishing heads can be moved between one of the polishing tables and at least one of the load-and-unload stations. The add-on polishing structure includes an additional polishing table and an additional polishing head that are operatively coupled to an add-on frame structure. The add-on polishing structure is configured to be attached to the main polishing structure to form a larger polishing structure with the additional polishing table and the additional polishing head.

A polishing apparatus for polishing semiconductor wafers in accordance with another embodiment of the invention comprises a main polishing structure and an add-on polishing structure. The main polishing structure includes a plurality of polishing tables, a plurality of polishing heads and a plurality of load-and-unload stations that are operatively coupled to a main frame structure. The polishing tables and the load-and-unload stations are positioned such that each polishing table is situated between the load-and-unload stations. The polishing heads are operatively coupled to the main frame structure such that each of the polishing heads can be linearly moved between one of the polishing tables and two of the load-and-unload stations. The one of the polishing tables is situated between the two of the load-and-unload stations. The add-on polishing structure includes an additional polishing table, an additional polishing head and a plurality of additional load-and-unload stations that are operatively coupled to an add-on frame structure. The add-on polishing structure is configured to be attached to the main polishing structure to form a larger polishing structure with the additional polishing table, the additional polishing head and the additional load-and-unload stations.

A polishing apparatus for polishing semiconductor wafers in accordance with another embodiment of the invention comprises a main polishing structure and an add-on polishing structure. The main polishing structure includes a first polishing table, a first polishing head and a first load-and-unload station that are operatively coupled to a main frame structure. The first polishing head is operatively coupled to the main frame structure such that the first polishing head can transfer the semiconductor wafers in a linear manner from the first polishing table to the first load-and-unload station using a first linear rail. The add-on polishing structure includes a second polishing table and a second polishing head that are operatively coupled to an add-on frame structure. The second polishing head is operatively coupled to the add-on frame structure such that the second polishing head can transfer the semiconductor wafers in a linear manner from the first load-and-unload station to the second polishing table using at least a second linear rail such that the second polishing head can receive the semiconductor wafers from the first load-and-unload station and polish the semiconductor wafers on the second polishing table. The add-on polishing structure is configured to be attached to the main polishing structure such that the first linear rail and the second linear rail are aligned to form a straightly connected linear rail.

Other aspects and advantages of the present invention will become apparent from the following detailed description, taken in conjunction with the accompanying drawings, illustrated by way of example of the principles of the invention.

DETAILED DESCRIPTION

Figure 1:
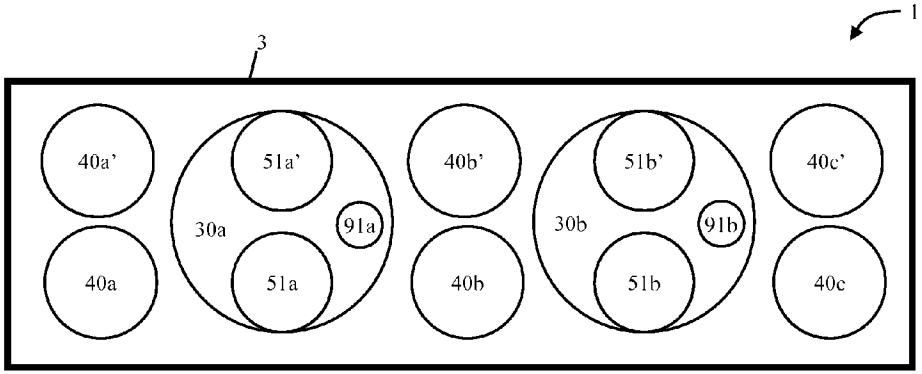
FIG. 1 is a diagram of a polishing apparatus in accordance with an embodiment of the present invention.

With reference of FIG. 1, a polishing apparatus 1 in accordance with an embodiment of the invention is described. The polishing apparatus 1 comprises polishing tables 30*a* and 30*b*, load-and-unload stations 40*a*, 40*a*', 40*b*, 40*b*', 40*c* and 40*c*', polishing heads 51*a*, 51*a*', 51*b* and 51*b*', and a frame structure 3, which is generally indicated as a rectangle in FIG. 1. The polishing tables 30*a* and 30*b*, the load-and-unload stations 40*a*, 40*a*', 40*b*, 40*b*', 40*c* and 40*c*', and the polishing or carrier heads 51*a*, 51*a*', 51*b* and 51*b*' are directly or indirectly attached to the frame structure 3. The frame structure 3 is described in more detail below with reference to FIGS. 3 and 4.

As shown in FIG. 1, the polishing tables 30*a* and 30*b* and the load-and-unload stations 40*a*, 40*a*', 40*b*, 40*b*', 40*c* and 40*c*' are attached to the frame structure 3 such that the first polishing table 30*a* is situated between the first and second load-and-unload stations 40*a* and 40*a*' and the third and fourth load-and-unload stations 40*b* and 40*b*' and the second polishing table 30*b* is situated between the third and fourth load-and-unload stations 40*b* and 40*b*' and the fifth and sixth load-and-unload stations 40*c* and 40*c*'. The first polishing head 51*a* is operatively attached to the frame structure 3 so that the polishing head 51*a* can be linearly moved between the first load-and-unload station 40*a*, the first polishing table 30*a* and the third load-and-unload station 40*b*. The second polishing head 51*a*' is also operatively attached to the frame structure 3 so that the polishing head 51*a*' can be linearly moved between the second load-and-unload station 40*a*', the first polishing table 30*a* and the fourth load-and-unload station 40*b*'. Similarly, the third polishing head 51*b* is operatively attached to the frame structure 3 so that the polishing head 51*b* can be moved between the third load-and-unload station 40*b*, the second polishing table 30*b* and the fifth load-and-unload station 40*c* and the fourth polishing head 51*b*' can be moved between the fourth load-and-unload station 40*b*', the second polishing table 30*b* and the sixth load-and-unload station 40*c*'.

The operation of the polishing apparatus 1 in accordance with an embodiment of the invention is now described. Two semiconductor wafers to be polished are transferred to the first and second load-and-unload stations 40*a* and 40*a*' by one or more external devices (not shown), e.g., wafer transfer robots. The polishing heads 51*a* and 51*a*' then transfer the wafers from the first and second load-and-unload stations 40*a* and 40*a*', respectively, to the first polishing table 30*a*, where the wafers are polished on the first polishing table 30*a* by the first and second polishing heads 51*a* and 51*a*'. After the wafers are polished on the first polishing table 30*a*, the wafers are transferred to the third and fourth load-and-unload stations 40*b* and 40*b*' by the first and second polishing heads 51*a* and 51*a*', respectively. The first and second polishing heads 51*a* and 51*a*' then move back to the first and second load-and-unload stations 40*a* and 40*a*' to process the next two wafers.

The third and fourth polishing heads 51*b* and 51*b*' transfer the polished wafers from the third and fourth load-and-unload stations 40*b* and 40*b*', respectively, to the second polishing table 30*b*, where the wafers are further polished on the second polishing table 30*b* by the third and fourth polishing heads 51*b* and 51*b*'. After the wafers are polished on the second polishing table 30*b*, the wafers are transferred to the fifth and sixth load-and-unload stations 40*c* and 40*c*' by the third and fourth polishing heads 51*b* and 51*b*', respectively. The polished wafers on the fifth and sixth load-and-unload stations 40*c* and 40*c*' can then be transferred to the next destination by one or more external devices (not shown), e.g., wafer transfer robots. The third and fourth polishing heads 51*b* and 51*b*' then move back to the third and fourth load-and-unload stations 40*b* and 40*b*' to continue to process the next two wafers.

In order to polish the wafers on the polishing tables 30*a* and 30*b*, a solution is dispensed on the polishing tables. In an embodiment, slurry containing abrasive particles is dispensed on polishing pads, which are attached on the polishing tables 30*a* and 30*b*. The polishing pads on the polishing tables 30*a* and 30*b* are conditioned by pad conditioners 91*a* and 91*b*, which are operatively attached to the frame structure 3 such that each pad conditioner can be moved in a linear manner to access different parts of the polishing pad being conditioned by that pad conditioner.

Since the polishing apparatus 1 has two polishing tables, the polishing apparatus 1 can sequentially perform two sequential or serial CMP processes on semiconductor wafers. Thus, the polishing apparatus 1 can be used to execute fabrication methods that require two serial CMP processes. However, unlike conventional polishing equipment, the polishing apparatus 1 can be modified or configured to perform more than two serial CMP processes.

Figure 2:
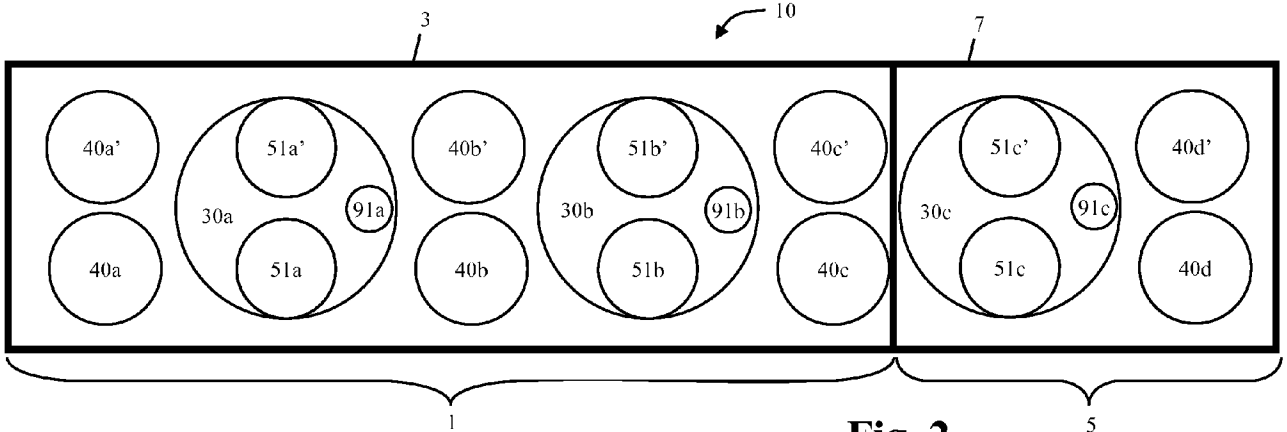
FIG. 2 is a diagram of an expanded polishing apparatus using the polishing apparatus of FIG. 1 in accordance with an embodiment of the invention.

In an embodiment, the polishing apparatus 1 can be converted into a larger, expanded polishing apparatus 10, which is shown in FIG. 2, by attaching an add-on polishing structure 5 to the polishing apparatus 1. Thus, the polishing apparatus 1 is the main polishing structure to which the add-on polishing structure 5 is attached to form the expanded polishing apparatus 10. As shown in FIG. 2, the add-on polishing structure 5 includes a polishing table 30*c*, load-and-unload stations 40*d* and 40*d*', polishing heads 51*c* and 51*c*', a pad conditioner 91*c*, and an add-on frame structure 7, which is generally indicated as a rectangle in FIG. 2. The polishing table 30*c*, the load-and-unload stations 40*d* and 40*d*', and the polishing heads 51*d* and 51*d*' are directly or indirectly attached to the add-on frame structure 7. The add-on frame structure 7 is described in more detail below with reference to FIG. 8.

As shown in FIG. 2, the third polishing table 30*c* and the seventh and eight load-and-unload stations 40*d* and 40*d*' are attached to the add-on frame structure 7 such that third polishing table 30*c* is positioned between the fifth and sixth load-and-unload stations 40*c* and 40*c*' and the seventh and eighth load-and-unload stations 40*d* and 40*d*' when the add-on polishing structure 5 is attached to the polishing apparatus 1. The fifth polishing head 51*c* is operatively attached to the add-on frame structure 7 so that the fifth polishing head 51*c* can be linearly moved between the fifth load-and-unload station 40*c*, the third polishing table 30*c* and the seventh load-and-unload station 40*d*. The sixth polishing head 51*c*' is also operatively attached to the add-on frame structure 7 so that the sixth polishing head 51*c*' can be linearly moved between the sixth load-and-unload station 40*c*', the third polishing table 30*c* and the eighth load-and-unload station 40*d*'.

The operation of the expanded polishing apparatus 10 in accordance with an embodiment of the invention is now described. The operation of the expanded polishing apparatus 10 with respect to the section corresponding to the original polishing apparatus 1 is similar to the operation of the polishing apparatus 1 of FIG. 1, and thus, will not be repeated. After the wafers are transferred to the fifth and sixth load-and-unload stations 40*c* and 40*c*' by the third and fourth polishing heads 51*b* and 51*b*', respectively, the fifth and sixth polishing heads 51*c* and 51*c*' transfer the wafers from the fifth and sixth load-and-unload stations 40*c* and 40*c*', respectively, to the third polishing table 30*c*, where the wafers are polished on the third polishing table 30*c* by the fifth and sixth polishing heads 51*c* and 51*c*'. After the wafers are polished on the third polishing table 30*c*, the wafers are transferred to the seventh and eighth load-and-unload stations 40*d* and 40*d*' by the fifth and sixth polishing heads 51*c* and 51*c*', respectively. The polished wafers on the seventh and eighth load-and-unload stations 40*d* and 40*d*' can then be transferred to the next destination by one or more external devices (not shown), e.g., wafer transfer robots. The fifth and sixth polishing heads 51*c* and 51*c*' then move back to the fifth and sixth load-and-unload stations 40*c* and 40*c*' to continue to process the next two wafers.

In order to polish the wafers on the third polishing table 30*c*, a solution is dispensed on the third polishing table 30*c*. In an embodiment, slurry containing abrasive particles is dispensed on a polishing pad, which is attached on the third polishing table 30*c*. The polishing pad on the third polishing table 30*c* is conditioned by the third pad conditioner 91*c*, which is operatively attached to the add-on frame structure 7 so that the third pad conditioner 91*c* can be moved in a linear manner to access different parts of the polishing pad on the third polishing table 30*c*.

Since the expanded polishing apparatus 10 has three polishing tables, the expanded polishing apparatus can sequentially perform three serial CMP processes on semiconductor wafers. Thus, the polishing apparatus 1 can be used to sequentially perform two serial CMP processes, or be converted to the polishing apparatus 10 to sequentially perform three serial CMP processes. However, in other embodiments, the polishing apparatus 1 and/or the expanded polishing apparatus 10 may be modified to include more than the described numbers of polishing tables so that the polishing apparatus 1 can sequentially perform more than two serial CMP processes and/or the expanded polishing apparatus 10 can sequentially perform more than three serial CMP processes. In other embodiments, more than one add-on polishing structure may be attached to the polishing apparatus 1 to form a larger polishing structure with more polishing tables.

Figure 4:
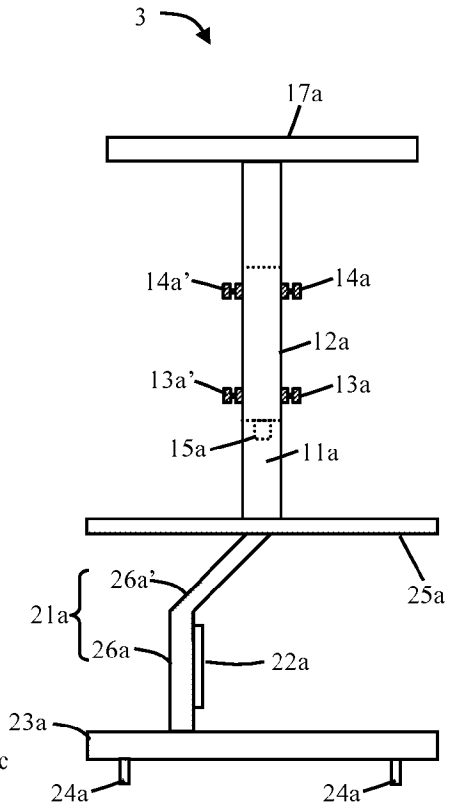
FIG. 4 is a side view of the frame structure of FIG. 3.
Figure 3:
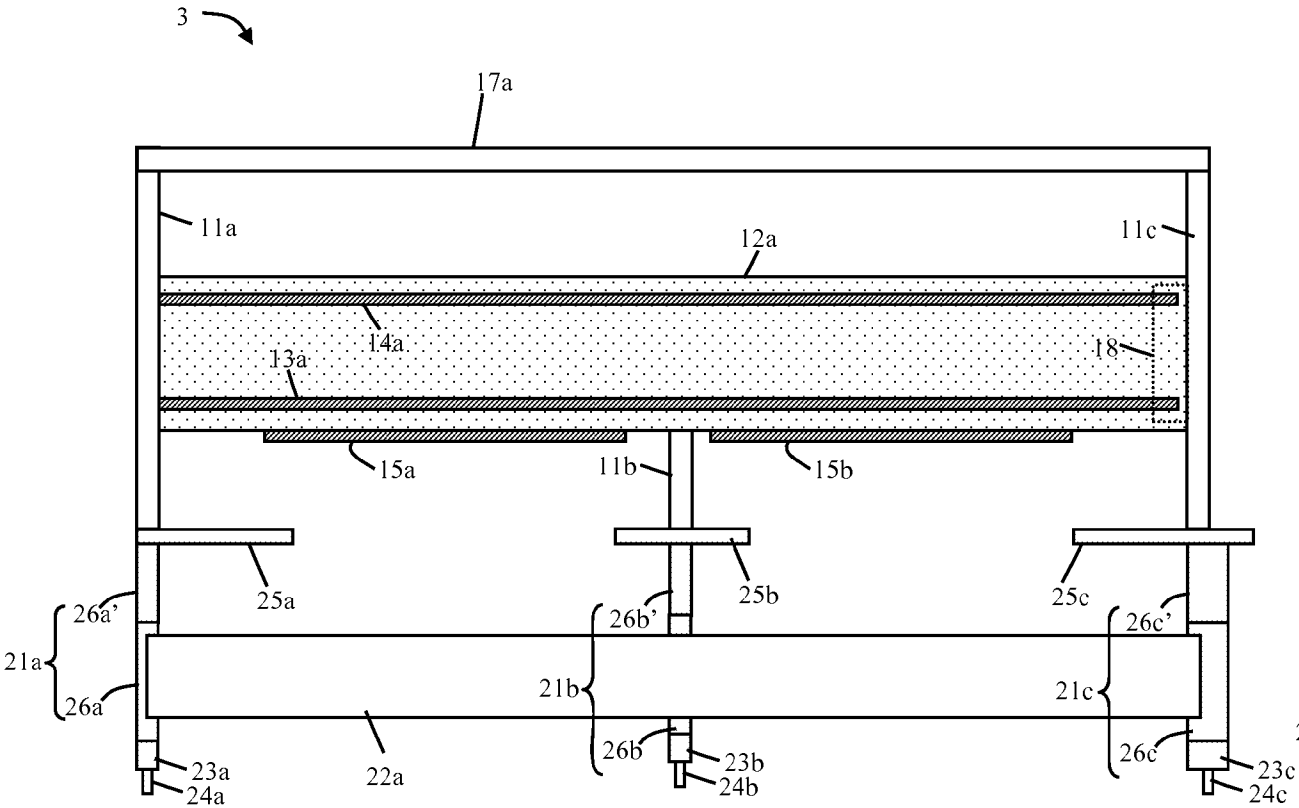
FIG. 3 is a front view of a frame structure of the polishing apparatus of FIG. 1 in accordance with an embodiment of the invention.

Turning now to FIGS. 3 and 4, the frame structure 3 in accordance with an embodiment of the invention is shown. FIG. 3 shows a front view of the frame structure 3 of the polishing apparatus 1. FIG. 4 shows a side view of the frame structure 3 of the polishing apparatus 1.

As best shown in FIG. 3, the frame structure 3 includes lower supporting structures 21*a*, 21*b* and 21*c*. The first lower supporting structure 21*a* comprises a vertical portion 26*a* and a tilted portion 26*a*', as illustrated in FIG. 4. One of the ends of the vertical portion 26*a* is connected to a first base frame 23*a* near a first end of the first base frame 23*a*, which is mounted on legs 24*a*. The other end of the vertical portion 26*a* is connected to one of the ends of the tilted portion 26*a*'. The other end of the tilted portion 26*a*' is connected to a central portion of a bottom surface of a first middle mounting plate 25*a*.

The second lower supporting structure 21*b* also comprises a vertical portion 26*b* and a tilted portion 26*b*'. One of the ends of the vertical portion 26*b* is connected to a second base frame 32*b* near a first end of the second base frame 23*b*, which is mounted on legs 24*b*. The other end of the vertical portion 26*b* is connected to one of the ends of the tilted portion 26*b*'. The other end of the tilted portion 26*b*' is connected to a central portion of a bottom surface of a second middle mounting plate 25*b*.

The third lower supporting structure 21*c* also comprises a vertical portion 26*c* and a tilted portion 26*c*'. One of the ends of the vertical portion 26*c* is connected to a third base frame 23*c* near a first end of the third base frame 23*c*, which is mounted on legs 24*c*. The other end of the vertical portion 26*c* is connected to one of the ends of the tilted portion 26*c*'. The other end of the tilted portion 26*c*' is connected to a central portion of a bottom surface of a third middle mounting plate 25*c*.

The frame structure 3 further includes a lower mounting plate 22*a*, which is mounted to the vertical portions 26*a*-26*c* of the first, second and third lower supporting structures 21*a*-21*c*. The frame structure 3 also includes upper supporting structures 11*a*, 11*b* and 11*c*. The first upper supporting structure 11*a* is mounted on a top surface of the first middle mounting plate 25*a*. The second upper supporting structure 11*b* is mounted on a top surface of the second middle mounting plate 25*b*. The third upper supporting structure 11*c* is mounted on a top surface of the third middle mounting plate 25*c*.

The frame structure 3 further includes an upper mounting plate 12*a*, which is welded to the upper supporting structures 11*a* and 11*b* such that a first side end of the mounting plate 12*a* is connected to the first upper supporting structure 11*a* and a bottom surface of the mounting plate 12*a* is mounted on the second upper supporting structure 11*b*. The upper mounting plate 12*a* is jointed to the third upper supporting structure 11*c* such that a second side end of the mounting plate 12*a* is jointed to the third upper supporting structure 11*c*. The upper supporting structure 11*c* comprises a male portion 18, which is jointed to a female portion of the second side end of the upper mounting plate 12*a*. The frame structure 3 also includes an upper frame 17*a*, which is mounted to the first and third upper supporting structures 11*a* and 11*c* at their tops.

Mounted on the mounting plate 12*a* are lower linear rails 13*a* and 13*a*', upper linear rails 14*a* and 14*a*' and conditioner linear rails 15*a* and 15*b*. The first lower linear rail 13*a* and the first upper linear rail 14*a* are mounted on the front vertical surface of the mounting plate 12*a* such that the rails 13*a* and 14*a* are parallel to a longitudinal side of the front surface of the mounting plate 12*a*. Thus, the rails 13*a* and 14*a* are parallel to each other. The second lower linear rail 13*a*' and the second upper linear rail 14*a*' are mounted on the back vertical surface of the mounting plate 12*a* such that the rails 13*a*' and 14*a*' are parallel to a longitudinal side of the back surface of the mounting plate 12*a*. Thus, the rails 13*a*' and 14*a*' are parallel to each other, and also to the rails 13*a* and 14*a*. The first conditioner linear rail 15*a* and the second conditioner linear rail 15*b* are mounted to the bottom surface of the mounting plate 12*a*, and are also parallel to the rails 13*a*, 13*a*', 14*a* and 14*a*'. The bottom surface of the mounting plate 12*a* is perpendicular to the front and back surfaces of the mounting plate 12*a*. The conditioner linear rails 15*a* and 15*b* are separated by the second upper supporting structure 11*b*, which is connected to the bottom surface of the mounting plate 12*a*.

Figure 5:
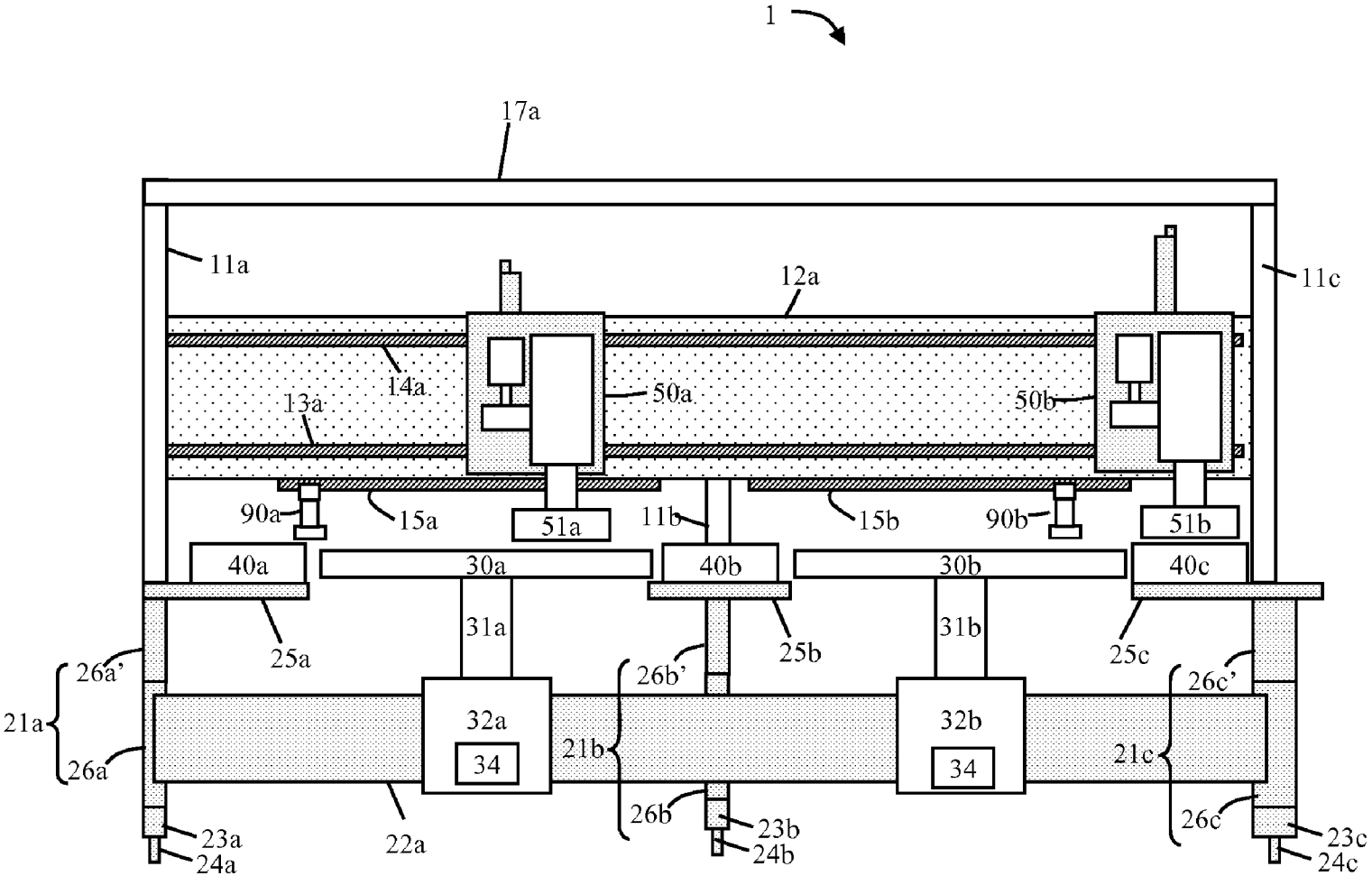
FIG. 5 is a front view of the polishing apparatus of FIG. 1 in accordance with an alternative embodiment of the present invention.

Turning now to FIG. 5, a front view of the polishing apparatus 1 is shown. In FIG. 5, the frame structure 3 of FIG. 3 is shown with the polishing tables 30*a* and 30*b*, the load-and-unload stations 40*a*, 40*a*', 40*b*, 40*b*', 40*c* and 40*c*', and the polishing heads 51*a*, 51*a*', 51*b* and 51*b*'. However, in FIG. 5, the load-and-unload stations 40*a*', 40*b*' and 40*c*', and the polishing heads 51*a*' and 51*b*' are hidden from view. As illustrated in FIG. 5, the polishing apparatus 1 further include a polishing head assembly for each of the polishing heads 51*a*, 51*a*', 51*b* and 51*b*' and a pad conditioner assembly for each of the pad conditioners 91*a* and 91*b*. In FIG. 5, only the polishing head assemblies 50*a* and 50*b* for the polishing heads 51*a* and 51*b*, respectively, are shown. The other two polishing head assemblies 50*a*' and 50*b*' for the polishing heads 51*a*' and 51*b*', respectively, are hidden from view. However, these hidden polishing head assemblies are similar to the shown polishing head assemblies 50*a* and 50*b*. Also shown in FIG. 5 are polishing table drive mechanisms 32*a* and 32*b*, which rotate the polishing tables 30*a* and 30*b*.

The polishing table drive mechanisms 32*a* and 32*b* are mounted to the first lower mounting plate 22*a* of the frame structure 3. The polishing tables 30*a* and 30*b* are connected to the polishing table drive mechanisms 32*a* and 32*b* through rotation shafts 31*a* and 31*b*, respectively. The polishing table 30*a* is rotated by the polishing table drive mechanism 32*a* via the rotation shaft 31*a*. Similarly, the polishing table 30*b* is rotated by the polishing table drive mechanism 32*b* via the rotation shaft 31*b*.

The first and second load-and-unload stations 40*a* and 40*a*' are mounted to the top surface of the first middle mounting plate 25*a*. The third and fourth load-and-unload stations 40*b* and 40*b*' are mounted to the top surface of the second middle mounting plate 25*b*. The fifth and sixth load-and-unload stations 40*c* and 40*c*' are mounted to the top surface of the third middle mounting plate 25*c*.

The first and third polishing head assemblies 50*a* and 50*b* are mounted to the first lower and upper linear rails 13*a* and 14*a* such that these polishing head assemblies 50*a* and 50*b*, which includes the polishing heads 51*a* and 51*b*, respectively, can move linearly along the rails 13*a* and 14*a*. Similarly, the second polishing head assembly 50*a*' (not shown) and the fourth polishing head assembly 50*b*' (not shown) are mounted to the second lower and upper linear rails 13*a*' and 14*a*' (not shown) such that these polishing head assemblies 50*a*' and 50*b*', which include the polishing heads 51*a*' and 51*b*', respectively, can move linearly along the rails 13*a*' and 14*a*'.

The first and second pad conditioner assemblies 90*a* and 90*b* are mounted to the first and second conditioner linear rails 15*a* and 15*b* such that these pad conditioner assemblies 90*a* and 90*b*, which include the pad conditioner 91*a* and 91*b*, respectively, can move linearly along the rails 15*a* and 15*b*, respectively.

In order to detect the end point of a polishing process at each of the polishing tables 30*a* and 30*b*, a current sensor 34 that is coupled to the polishing table drive mechanism 32*a* or 32*b* for that polishing table can be used. The current sensor 34 detects current that is used to spin a motor of the polishing table drive mechanism 32*a* or 32*b*. When frictional force between the polishing pad on the polishing table 30*a* or 30*b* and the two wafers being polished on that polishing pad changes, the current is changed in order to keep the spinning speed constant without being affected by the frictional force change. The current sensor 34 detects the current change, which can be used to determine the end point.

However, the current sensor 34 cannot be used to tell which of the two wafers that are polished at the same time on the same polishing table 30*a* or 30*b* is reaching or approaching the end point. To solve this problem, the current sensor 34 can be used in conjunction with load cells or other current sensors to determine the polishing end point for each of the two wafers being polished on the same polishing table 30*a* or 30*b*.

Figure 6:
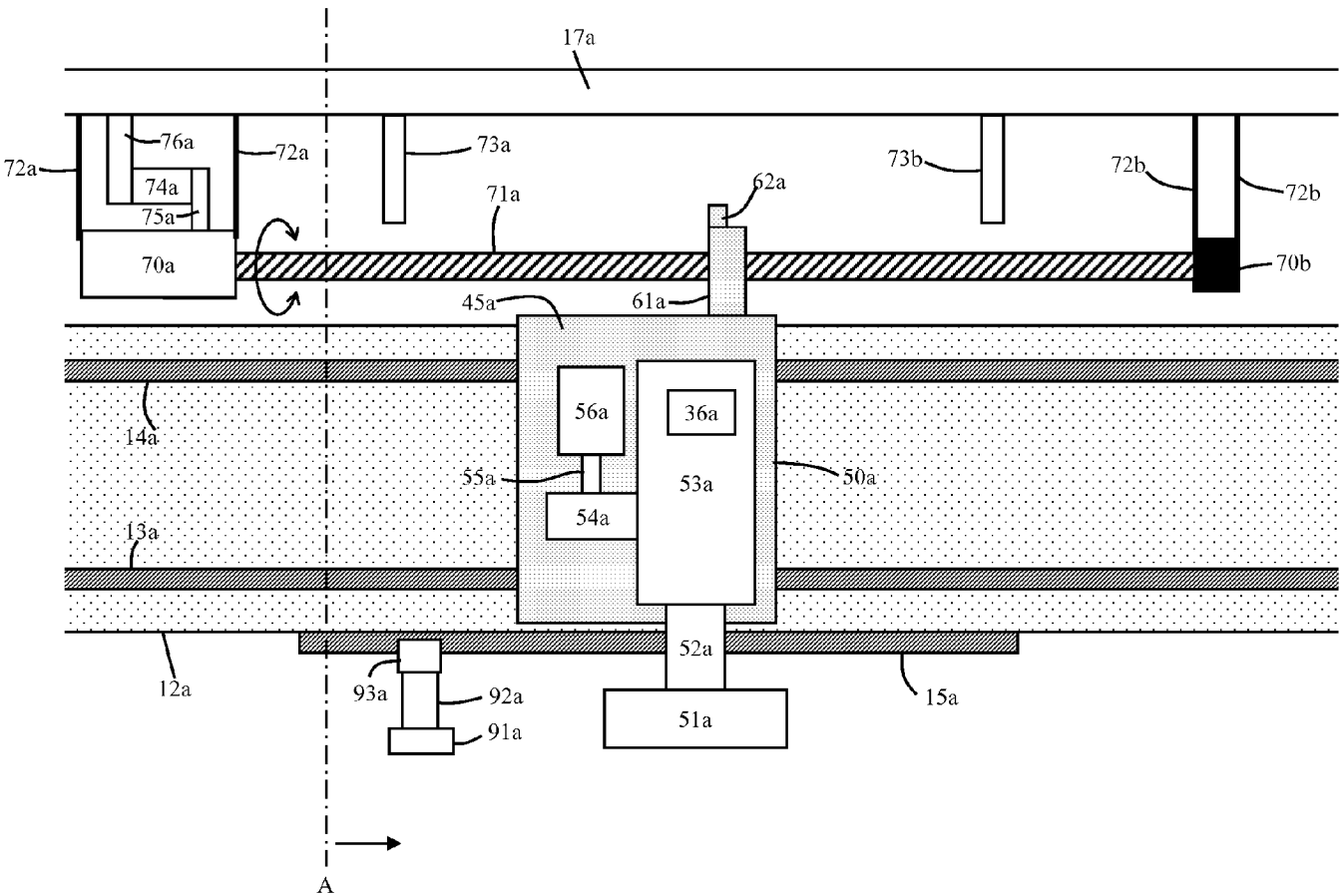
FIG. 6 is an enlarged view of a portion of the polishing apparatus of FIG. 5, illustrating a polishing head assembly, an associated linear drive mechanism and an associated end point detecting mechanism.
Figure 7:
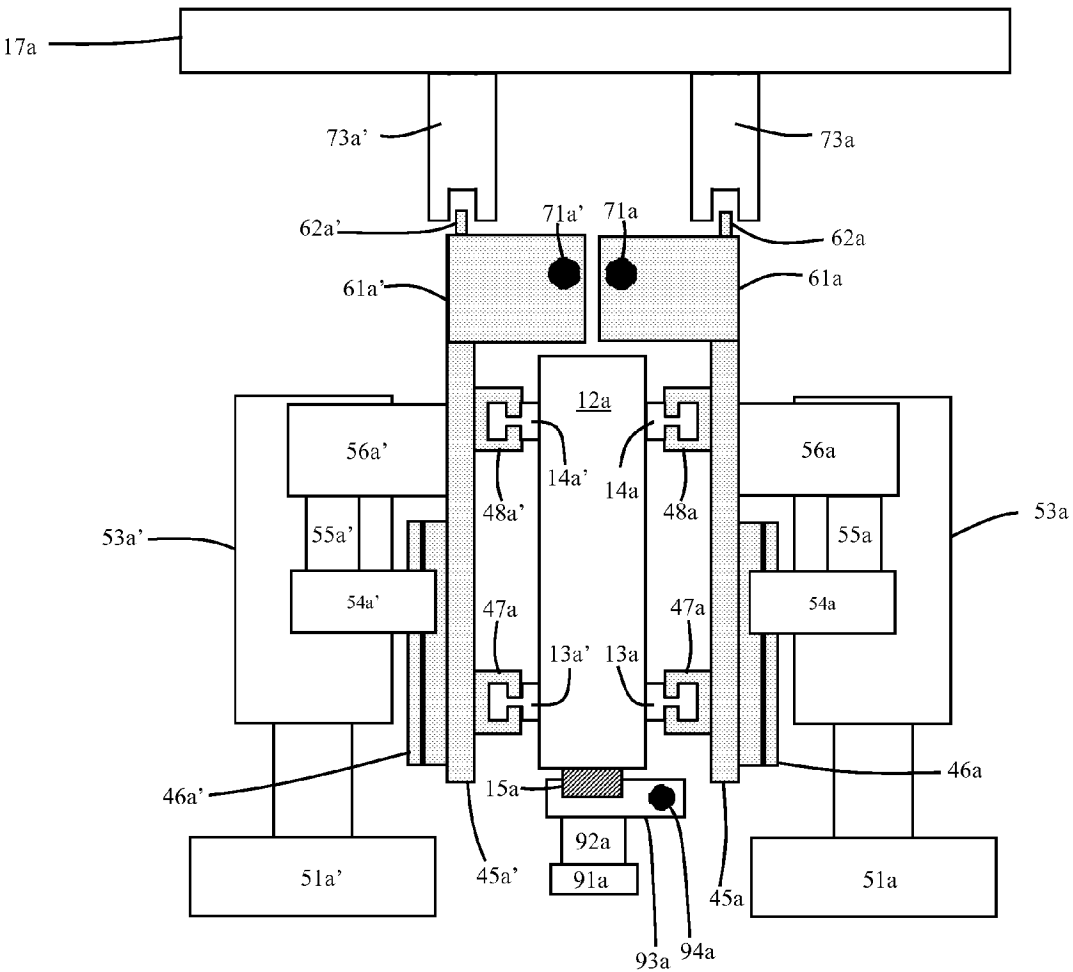
FIG. 7 is a cross-sectional view of the portion shown in FIG. 6.

With reference to FIGS. 6 and 7, the polishing head assembly 50*a*, an associated linear drive mechanism and an associated end point detecting mechanism are described. Since the polishing head assemblies 50*a*, 50*a*', 50*b* and 50*b*' are similar to each other, the description of the polishing head assembly 50*a* and the associated mechanisms will also serve as a description of the other polishing head assemblies and their linear drive mechanisms and end point detecting mechanisms. FIG. 6 is a front view of the polishing head assembly 50*a*, the associated linear drive mechanism and the associated end point detecting mechanism. FIG. 7 is a side view from the cross section A of FIG. 6.

The polishing head 51*a* is connected to a head rotating mechanism 53*a* through a head rotating shaft 52*a*. The head rotating mechanism 53*a* is connected to a supporting plate 54*a*, which is connected to a head vertical drive mechanism 56*a* through a shaft 55*a*. The head vertical drive mechanism 56*a* is mounted to a head assembly plate 45*a*. The supporting plate 54*a* is slidably mounted to a guide rail plate 46*a* such that the polishing head 51*a* can move vertically by the head vertical drive mechanism 56*a* along a guide rail of the guide rail plate 46*a*. The head assembly plate 45*a* is slidably coupled to the first lower and upper linear rails 13*a* and 14*a* through a lower rail gripper 47*a* and an upper rail gripper 48*a*. The lower and upper rail grippers 47*a* and 48*a* are slidably coupled to the lower and upper linear rails 13*a* and 14*a*, respectively.

A lead nut 61*a* is coupled to the head assembly plate 45*a*. The lead nut 61*a* is also coupled to a lead screw 71*a*. One end of the lead screw 71*a* is connected to a head transport motor 70*a*, which is suspended from the upper frame 17*a* by at least one elastic metallic or polymeric plate 72*a*. The other end of the lead screw 71*a* is connected to a bearing 70*b*, which is suspended from the upper frame 17*a* by at least elastic metallic or polymeric plate 72*b*. The lead nut 61*a* moves back and forth along the lead screw 71*a* as the lead screw 71*a* is rotated by the head transport motor 70*a*.

First and second position sensors 73*a* and 73*b* are mounted to the first upper frame 17*a* so that these position sensors can detect when the polishing head assembly 50*a* passes the position sensors. A reference pin 62*a* is mounted to the head assembly plate 45*a* so that the reference pin triggers one of the position sensors 73*a* and 73*b* when the polishing head assembly 50*a* passes that position sensor. The positioning sensors 73*a* and 73*b* may be magnetic sensors or photo sensors.

The position of the first position sensor 73*a* is set along the upper frame 17*a* such that first polishing head 51*a* is vertically aligned with the first load-and-unload station 40*a* when the first position sensor 73*a* detects the reference pin 62*a*. Similarly, the position of the second position sensor 73*b* is set along the upper frame 17*a* such that second polishing head 51*a* is vertically aligned with the third load-and-unload station 40*b* when the second position sensor 73*b* detects the reference pin 62*a*.

In an embodiment, a load cell 74*a* is used along with the current sensor 34 to detect the end point of a polishing process for the semiconductor wafer being polished by the first polishing head 51*a* on the first polishing table 30*a*. The load cell 74*a* is coupled to a first connect 75*a*, which is rigidly connected to the head transport motor 70*a*. The load cell 74*a* is also coupled to a second connect 76*a*, which is rigidly connected to the upper frame 17*a*.

During a polishing process, the first polishing head 51*a* moves linearly back and forth along the lead screw 71*a* in a cyclic manner. The torque to move the first polishing head assembly 50*a* back and forth is detected by the load cell 74*a*. The torque changes as frictional force between the polishing pad on the first polishing table 30*a* and the wafer being polished by the first polishing head 51*a* changes. The frictional force changes either when a top layer deposited on the wafer is planarized or when an under-layer deposited on the wafer is exposed after the top layer is removed by the polishing process. By detecting changes in torque using the load cell 74*a* and changes in current to the motor of the polishing table drive mechanism 32*a* using the current sensor 34, the end point of the polishing process is detected. A similar load cell for the second polishing head 51*a*' can be used to detect the end point of a polishing process for the wafer being polished by the second polishing head. Thus, the end point for each of the two wafers being simultaneously polished on the first polishing table 30*a* can be detected individually.

Specifically, by monitoring torque changes of two wafers being polished by two polishing heads on the same polishing table using the load cells associated with the two polishing heads, the wafer that is reaching or approaching the end point is identified. After identifying the wafer that is reaching or approaching the end point, the current sensor 34 coupled to the polishing table drive mechanism for the polishing table is used to detect and determine the end point of the wafer. After one of the two wafers has reached the end point, the polishing process for that wafer is stopped but the polishing process for the other wafer continues until the current sensor 34 detects and determines end point of the other wafer. This end point detecting and determining algorithm using the current sensor 34 with the help of load cells works well when signals obtained from the current sensor 34 has better quality (less noise) than signals obtained from the load cells.

In an alternative embodiment, rather than a load cell, a current sensor 36*a* that is coupled to the head rotating mechanism 53*a* is used along with the current sensor 34 to detect the end point of a polishing process for the semiconductor wafer being polished by the first polishing head 51*a* on the first polishing table 30*a*. The current sensor 36*a* detects changes in electrical current that is used to rotate the polishing head 51*a* by the head rotating mechanism 53*a*. When frictional force between the polishing pad on the polishing table 30*a* and the wafer being polished by the first polishing head 51*a* changes, the current to a motor of the head rotating mechanism 53*a* is changed in order to keep the spinning speed constant. The current sensor 36 detects this change in current. By detecting changes in current to the motor of the head rotating mechanism 53*a* using the current sensor 36*a* and changes in current to the motor of the polishing table drive mechanism 32*a* using the current sensor 34, the end point of the polishing process is detected. A similar current sensor for the second polishing head 51*a*' can be used to detect the end point of a polishing process for the wafer being polished by the second polishing head. Thus, the end point for each of the two wafers being simultaneously polished on the first polishing table 30*a* can be detected individually.

Specifically, by monitoring changes in current to rotate the two wafers using the current sensors associated with the two polishing heads, the wafer that is reaching or approaching the end point is identified. After identifying the wafer that is reaching or approaching the end point, the current sensor 34 coupled to the polishing table drive mechanism for the polishing table is used to detect and determine the end point of the wafer. After one of the two wafers has reached the end point, the polishing process for that wafer is stopped but the polishing process for the other wafer continues until the current sensor 34 detects and determines end point of the other wafer. This end point detecting and determining algorithm using the multiple current sensors works well when signals obtained from the current sensor 34 for the polishing table has better quality (less noise) than signals obtained from the current sensors for the polishing heads.

The pad conditioner assembly 90*a* is now described with reference to FIGS. 6 and 7. The pad conditioner head 91*a* is connected to a conditioner rotating-and-vertical drive mechanism 92*a*, which is connected to a lead nut 93*a*. The lead nut 93*a* is slidably coupled to the conditioner linear rail 15*a* and a lead screw 94*a*. One end of the lead screw 94*a* is connected to a conditioner transport motor (not shown). The conditioner linear transport motor is mounted to the first upper mounting plate 12*a*. The lead nut 93*a* moves along the lead screw 94*a* as the lead screw 94*a* is rotated by the conditioner linear transport motor.

Figure 8:
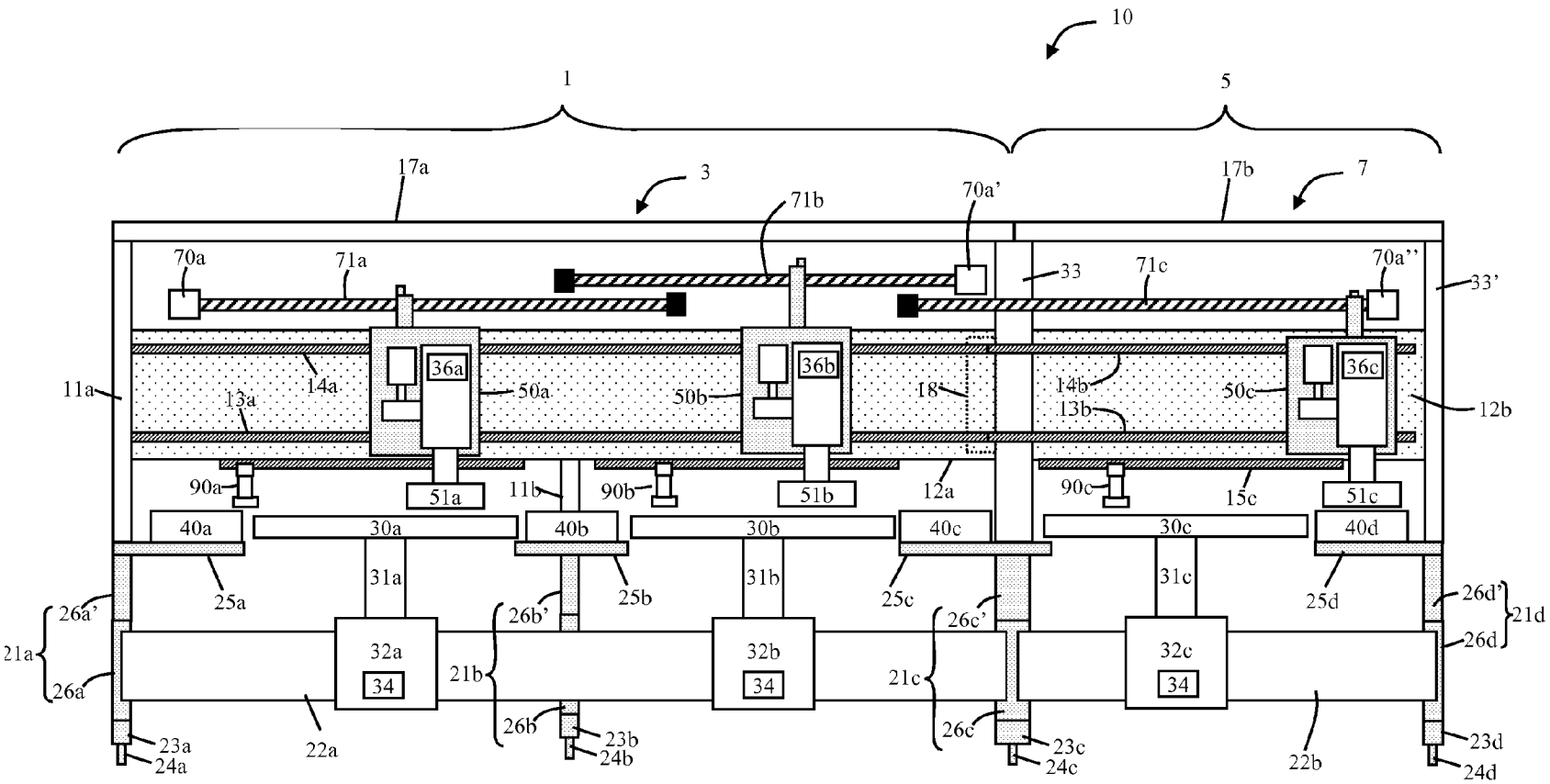
FIG. 8 is a front view of the expanded polishing apparatus of FIG. 2 in accordance with an embodiment of the present invention.

Turning now to FIG. 8, a front view of the expanded polishing apparatus 10 of FIG. 2 is shown. In order to convert the polishing apparatus 1 to the expanded polishing apparatus 10, the third upper supporting structure 11*c* of the polishing apparatus 1 is replaced with an upper frame assembly of the add-on frame structure 7, which is part of the add-on polishing structure 5. The add-on frame structure 7 also includes a second upper frame 17*b*, a fourth lower supporting structure 21*d*, a second lower mounting plate 22*b*, a fourth base frame 23*d*, legs 24*d* and a fourth middle mounting plate 25*d*. The upper frame assembly comprises a fourth upper supporting structure 33, a fifth upper supporting structure 33' and a second upper mounting plate 12*b*, which are welded together. The fourth upper supporting structure 33 comprises a male portion 18', which is firmly jointed to the female portion of the first upper mounting plate 12*a*. The fourth upper supporting structure 33 is mounted on the top surface of the third middle mounting plate 25*c*. The fifth upper supporting structure 33' is mounted on a top surface of the fourth middle mounting plate 25*d*. The second upper frame 17*b* is mounted to the fourth and fifth supporting structures 33 and 33' at their tops.

The fourth middle mounting plate 25*d* is mounted to the fourth lower supporting structure 21*d*, which comprises a vertical portion 26*d* and a tilted portion 26*d*'. One of the ends of the vertical portion 26*d* is connected to the fourth base frame 23*d* near a first end of the fourth base frame 23*d*, which is mounted on the legs 24*d*. The other end of the vertical portion 26*d* is connected to one of the ends of the tilted portion 26*d*40 . The other end of the tilted portion 26*d*' is connected to a central portion of a bottom surface of the fourth middle mounting plate 25*d*.

The seventh and eighth load-and-unload stations 40*d* and 40*d*' are mounted to the fourth middle mounting plate 25*d*. The second lower mounting plate 22*b* is mounted to the vertical portions 26*c* and 26*d* of the third and fourth lower supporting structures 21*c* and 21*d*.

The add-on polishing structure 5 further includes a third polishing table drive mechanism 32*c*, which is mounted to the second lower mounting plate 22*b*. The third polishing table 30*c* is connected to the third polishing table drive mechanism 32*c* through a rotation shaft 31*c*. The third polishing table 30*c* is rotated by the polishing table drive mechanism 32*c* via the rotation shaft 31*c*.

The add-on polishing structure 5 further includes lower linear rail 13*b* and 13*b*', upper linear rails 14*b* and 14*b*' and a conditioner linear rail 15*c*, which are mounted on the second upper mounting plate 12*b*. The lower linear rail 13*b*' and the upper linear rail 14*b*' are not shown in FIG. 8. The third lower linear rail 13*b* and the third upper linear rail 14*b* are mounted on the front vertical surface of the second mounting plate 12*b* such that the rails 13*b* and 14*b* are parallel to a longitudinal side of the front surface of the second mounting plate 12*b*. Thus, the rails 13*b* and 14*b* are parallel to each other. One end of the third lower linear rail 13*b* is aligned with one end of the first lower linear rail 13*a* such that the third lower linear rail 13*b* and the first lower linear rail 13*a* form a straightly connected lower linear rail. Similarly, one end of the third upper linear rail 14*b* is aligned with one end of the first upper linear rail 14*a* such that the third upper linear rail 14*b* and the first upper linear rail 14*a* form a straightly connected upper linear rail. Similar to the third lower linear rail 13*b* and the third upper linear rail 14*b*, the fourth lower linear rail 13*b*' and the fourth upper linear rail 14*b*' are mounted on the back vertical surface of the second mounting plate 12*b*' such that the rails 13*b*' and 14*b*' are parallel to a longitudinal side of the back surface of the second mounting plate 12*b*. Thus, the rails 13*b*' and 14*b*' are parallel to each other, and also to the rails 13*b* and 14*b*. One end of the fourth lower linear rail 13*b*' is aligned with one end of the second lower linear rail 13*a*' such that the fourth lower linear rail 13*b*' and the second lower linear rail 13*a*' form another straightly connected lower linear rail. Similarly, one end of the fourth upper linear rail 14*b*' is aligned with one end of the second upper linear rail 14*a*' such that the fourth upper linear rail 14*b*' and the second upper linear rail 14*a*' form another straightly connected upper linear rail.

The fifth polishing head assembly 50*c* is mounted to the third lower and upper linear rails 13*b* and 14*b*. The fifth polishing head assembly 50*c* moves linearly between the fifth load-and-unload station 40*c*, the third polishing table 30*c* and the seventh load-and-unload station 40*d* along the straightly connected lower linear rail formed by the first and third lower linear rails 13*a* and 13*b* and the straightly connected upper linear rail formed by the first and third upper linear rails 14*a* and 14*b*. The fifth polishing head assembly 50*c* is linearly moved using a lead screw 71*c* connected to a head transport motor 70*a*" in a similar manner as the first polishing head assembly 50*a* using the lead screw 71*a* and the head transport motor 70*a*, which was previously described with reference FIGS. 6 and 7.

Although not shown, the sixth polishing head assembly 50*c*' is mounted to the fourth lower and upper linear rails 13*b*' and 14*b*'. The sixth polishing head assembly 50*c*' moves linearly between the sixth load-and-unload station 40*c*', the third polishing table 30*c* and the eighth load-and-unload station 40*d*' along the straightly connected lower linear rail formed by the second and fourth lower linear rails 13*a*' and 13*b*' and the straightly connected upper linear rail formed by the second and fourth upper linear rails 14*a*' and 14*b*'. The sixth polishing head assembly 50*c*' is linearly moved using a lead screw connected to a head transport motor in a similar manner as the first polishing head assembly 50*a* using the lead screw 71*a* and the head transport motor 70*a*, which was previously described with reference FIGS. 6 and 7.

In an embodiment, a load cell (not shown) is used to detect changes in torque with respect to each of the fifth and sixth polishing head assemblies 50*c* and 50*c*'. The load cell for each of the fifth and sixth polishing head assemblies 50*c* and 50*c*' is used with a current sensor 34 that is coupled to a motor of the polishing table drive mechanism 32*c* to detect the end point of a polishing process for each wafer being polished by the polishing heads 51*c* and 51*c*'. In an alternative embodiment, additional current sensors 36*c* or 36*c*' (the current sensor 36*c*' not shown) in the fifth and sixth polishing head assemblies 50*c* and 50*c*' are used to detect changes in current being used to rotate the polishing heads 51*c* and 51*c*'. The additional current sensors 36*c* or 36*c*' for the fifth and sixth polishing head assemblies 50*c* and 50*c*' are used with the current sensor 34 that is coupled to a motor of the polishing table drive mechanism 32*c* to detect the end point of a polishing process for each wafer being polished by the polishing heads 51*c* and 51*c*'.

The third conditioner linear rail 15*c* is mounted to the bottom surface of the second mounting plate 12*b*, and are also parallel to the rails 13*b*, 13*b*', 14*b* and 14*b*'. The bottom surface of the second mounting plate 12*b* is perpendicular to the front and back surfaces of the second mounting plate 12*b*. The third pad conditioner assembly 90*c* is slidably coupled to the third conditioner linear rail 15*c*.

Figure 9:
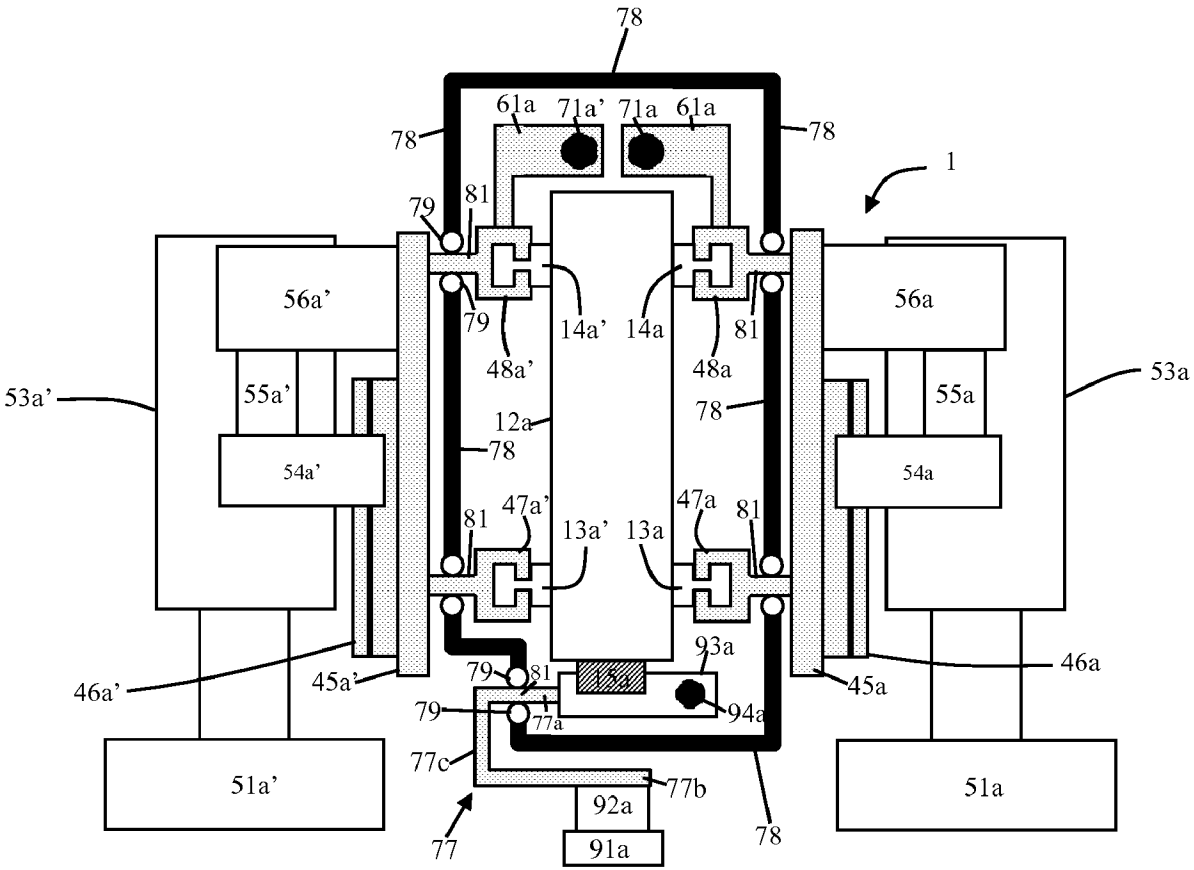
FIG. 9 is a cross-sectional view of a portion of the polishing apparatus of FIG. 5, illustrating an enclosing structure in accordance with an embodiment of the invention.

With reference to FIG. 9, a pad conditioner assembly for the polishing apparatus 1 according to an embodiment of the invention is described. In the polishing apparatus 1 of FIG. 9, the conditioner rotating-and-vertical drive mechanism 92*a* is connected to a mounting plate 77. The mounting plate 77 has a shape of "⊏", which includes an upper horizontal portion 77*a*, a lower horizontal portion 77*b* and a vertical portion 77*c*. The upper horizontal potion 77*a* of the mounting plate 77 comprises a thin neck portion 81, which is similar to thin neck portions 81 of the lower and upper rail grippers 47*a*, 48*a*, 47*a*' and 48*a*' that are described below. The upper horizontal portion 77*a* of the mounting plate 77 is coupled to the lead nut 93*a*. The lower horizontal portion 77*b* of the mounting plate 77 is connected to the conditioner rotating-and-vertical drive mechanism 92*a*. The upper horizontal potion 77*a* and the lower horizontal portion 77*b* are connected to each other through the vertical portion 77*c*.

The lead nut 93*a* is slidably coupled to the conditioner linear rail 15*a* and the lead screw 94*a*. One end of the lead screw 94*a* is connected to the conditioner transport motor (not shown). The conditioner linear transport motor is mounted to the first upper mounting plate 12*a*. The lead nut 93*a* moves along the lead screw 94*a* as the lead screw 94*a* is rotated by the conditioner linear transport motor.

With reference to FIG. 9, an enclosing structure 78 for the polishing apparatus 1 in accordance with an embodiment of the invention is described. FIG. 9 shows a cross section of the enclosing structure 78 and the polishing apparatus 1. In the polishing apparatus 1 of FIG. 9, the lower and upper rail grippers 47*a*, 48*a*, 47*a*' and 48*a*' are connected to the respective head assembly plates 45*a* and 45*a*' through their respective thin neck portions 81.

As shown in FIG. 9, the enclosing structure 78 encloses the first upper mounting plate 12*a*, the lower linear rails 13*a* and 13*a*', the upper linear rails 14*a* and 14*a*', the conditioner linear rails 15*a*, most of the lower rail grippers 47*a* and 47*a*', most of the upper rail grippers 48*a* and 48*a*', the lead nut 93*a*, the lead screw 94*a*, and all other similar components of the polishing apparatus 1. The enclosing structure 78 also encloses a part of the horizontal portion 77*a* of the mounting plate 77. The enclosing structure 78 does not enclose the horizontal portion 77*b* of the mounting plate 77. Thus, the polishing heads 51*a*, 51*a*', 51*b*, 51*b*', 51*c* and 51*c*' and the pad conditioner 91*a* and 91*b* are external to the enclosing structure 78. Although the enclosing structure 78 is described with reference to the polishing apparatus 1, the enclosing structure 78 may be modified to be used with the expanded polishing apparatus 10 to enclose similar components of the expanded polishing apparatus 10.

The enclosing structure 78 comprises linearly elongated openings for the thin neck portions 81 of the lower and upper rail grippers 47*a*, 48*a*, 47*a*' and 48*a*' and the thin neck portion 81 of the mounting plate 77. The neck portions 81 move along the openings of the enclosing structure 78. The openings are sealed with soft polymeric material 79, such as Teflon, polyurethane and silicon rubber, such that friction between the neck portions 81 and the sealing do not generate hard particles that may fall into the polishing pads and damage the wafers. The neck portions 81 of the lower and upper rail grippers 47*a*, 48*a*, 47*a*' and 48*a*' move through the sealing when the associated head assembly moves along the linear rails 13*a* and 14*a* or the linear rails 13*a*' and 14*a*'. Similarly, the thin neck portion 81 of the mounting plate 77 moves through the sealing when the pad conditioner 91*a* and other components connected to the pad conditioner 91*a* move along the linear rail 15*a*. The neck portions 81 may be coated with same soft polymeric material 79 that is used for the sealing.

Figure 10:
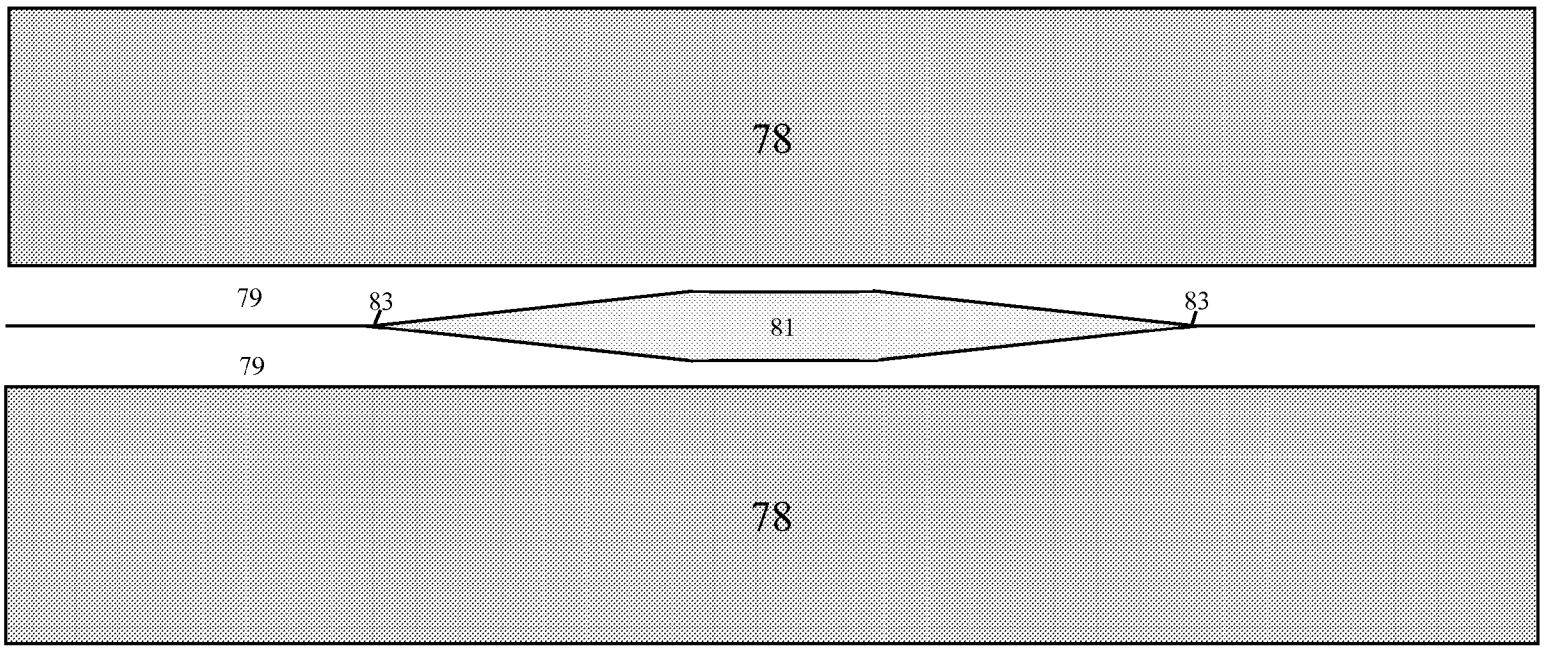
FIG. 10 is a diagram showing an opening of the enclosing structure and a thin neck section in the opening in accordance with an embodiment of the invention.

As illustrated in FIG. 10, both ends 83 of each neck portion 81 may be shaped to be sharp. That is, each end 83 of the neck portion 81 may taper to a sharp point. This configuration ensures that the opening of the enclosing structure 78 is tightly sealed at the ends 83 of the neck portion 81 by the sealing, as shown in FIG. 10.

Although the foregoing description sets forth exemplary embodiments and methods of operation of the invention, the scope of the invention is not limited to these specific embodiments or described methods of operation. Many details have been disclosed that are not necessary to practice the invention, but have been included to sufficiently disclose the best mode of operation, and manner and process of making and using the invention. Modification may be made to the specific form and design of the invention without departing from its spirit and scope as expressed in the following claims.

What is claimed is:

1. A polishing apparatus for polishing semiconductor wafers comprising:

a main polishing structure including a plurality of polishing tables, a plurality of polishing heads and a plurality of load-and-unload stations that are operatively coupled to a main frame structure, said polishing heads being operatively coupled to said main frame structure such that each of said polishing heads can be moved between one of said polishing tables and at least one of said load-and-unload stations, wherein said polishing heads are operatively attached to said main frame structure such that each of said polishing heads can be linearly moved between said one of said polishing tables and said at least one of said load-and-unload stations; and an add-on polishing structure including an additional polishing table and an additional polishing head that are operatively coupled to an add-on frame structure, said add-on polishing structure being configured to be attached to said main polishing structure to form a larger polishing structure with said additional polishing table and said additional polishing head.

2. The polishing apparatus of claim 1 wherein said add-on polishing structure is attached to said main polishing structure, wherein said add-on polishing structure further includes at least one additional load-and-unload station, and wherein said additional polishing head is operatively attached to said add-on frame structure such that said additional polishing head can be linearly moved between said additional polishing table, said at least one additional load-and-unload station and one of said load-and-unload stations of said main polishing structure.

3. The polishing apparatus of claim 1 wherein said polishing heads are operatively attached to said main frame structure such that each of said polishing heads can be linearly moved between two of said load-and-unload stations and one of said polishing tables that is situated between said two of said load-and-unload stations.

4. The polishing apparatus of claim 3 wherein pairs of said polishing heads are operatively attached to said main frame structure such that each pair of said polishing heads can be linearly moved to one of said polishing tables to simultaneously polish wafers on that polishing table.

5. The polishing apparatus of claim 1 wherein said main frame structure includes an upper mounting plate with at least one linear rail mounted on a vertical surface of said upper mounting plate, said at least one linear rail being used to linearly guide at least one of said polishing heads.

6. The polishing apparatus of claim 5 wherein at least one additional linear rail is mounted on another vertical surface of said upper mounting plate, said another vertical surface being the opposite surface of said vertical surface, said at least one additional linear rail being used to linearly guide at least another one of said polishing heads.

7. The polishing apparatus of claim 5 wherein said main polishing structure includes a lead screw connected to a head transport motor for each of said polishing heads, said lead screw and said head transport motor being used to linearly move that polishing head.

8. The polishing apparatus of claim 5 wherein said main polishing structure includes a load cell connected to said head transport motor for at least one of said polishing heads to detect changes in torque for polishing end point detection, and wherein said main polishing structure includes a current sensor connected to a polishing table drive mechanism for at least one of said polishing tables to detect changes in electrical current being used by said polishing table drive mechanism, said load cell being used in conjunction with said current sensor for said polishing end point detection.

9. The polishing apparatus of claim 5 wherein said main polishing structure includes a current sensor connected to a head rotating mechanism for at least one of said polishing heads to detect changes in electrical current being used by said head rotating mechanism, and wherein said main polishing structure includes another current sensor connected to a polishing table drive mechanism for at least one of said polishing tables to detect changes in electrical current being used by said polishing table drive mechanism, said current sensor being used in conjunction with said another current sensor for said polishing end point detection.

10. The polishing apparatus of claim 5 wherein said add-on frame structure includes an additional upper mounting plate with at least one additional linear rail mounted on a vertical surface of said additional upper mounting plate, said at least one additional linear rail being aligned with said at least one linear rail of said main frame structure when said add-on polishing structure is attached to said main polishing structure, said at least one additional linear rail being used to linearly guide said additional polishing head.

11. The polishing apparatus of claim 5 wherein said main polishing structure includes a pad conditioner for each of said polishing tables, and wherein a conditioner linear rail is mounted on a bottom surface of said upper mounting plate, said conditioner linear rail being used to linearly guide said pad conditioner.

12. The polishing apparatus of claim 11 wherein said pad conditioner is attached to a mounting plate that has a shape of "⊏", said mounting plate including an upper horizontal portion, a lower horizontal portion and a vertical portion that connects said upper and lower horizontal portions, said mounting plate being used to connect said pad conditioner to said conditioner linear rail.

13. The polishing apparatus of claim 12 further comprising an enclosing structure to enclose said upper mounting plate such that said polishing heads and said pad conditioner are external to said enclosing structure, said enclosing structure including openings to accommodate neck portions of rail grippers for said polishing heads and said upper horizontal portion of said mounting plate, said rail grippers being used to connect said polishing heads to said at least one linear rail.

14. The polishing apparatus of claim 13 wherein at least some of said openings of said enclosing structure are sealed with sealing material, and wherein said neck portions are configured such that each neck portion tapers to a point at both ends so that said openings of said enclosing structure are sealed by said sealing material at said both ends of said neck portions.

15. A polishing apparatus for polishing semiconductor wafers comprising:

a main polishing structure including a plurality of polishing tables, a plurality of polishing heads and a plurality of load-and-unload stations that are operatively coupled to a main frame structure, said polishing tables and said load-and-unload stations being positioned such that each polishing table is situated between said load-and-unload stations, said polishing heads being operatively coupled to said main frame structure such that each of said polishing heads can be linearly moved between one of said polishing tables and two of said load-and-unload stations, said one of said polishing tables being situated between said two of said load-and-unload stations; and an add-on polishing structure including an additional polishing table, an additional polishing head and a plurality of additional load-and-unload stations that are operatively coupled to an add-on frame structure, said add-on polishing structure being configured to be attached to said main polishing structure to form a larger polishing structure with said additional polishing table, said additional polishing head and said additional load-and-unload stations.

16. The polishing apparatus of claim 15 wherein said add-on polishing structure is attached to said main polishing structure, and wherein said additional polishing head is operatively attached to said add-on frame structure such that said additional polishing heads can be linearly moved between said additional polishing table, one of said additional load-and-unload station and one of said load-and-unload stations of said main polishing structure.

17. The polishing apparatus of claim 15 wherein pairs of said polishing heads are operatively attached to said main frame structure such that each pair of said polishing heads can be linearly moved to one of said polishing tables to simultaneously polish wafers on that polishing table.

18. The polishing apparatus of claim 15 wherein said main frame structure includes an upper mounting plate with at least one linear rail mounted on a vertical surface of said upper mounting plate, said at least one linear rail being used to linearly guide at least one of said polishing heads.

19. The polishing apparatus of claim 18 wherein at least one additional linear rail is mounted on another vertical surface of said upper mounting plate, said another vertical surface being the opposite surface of said vertical surface, said at least one additional linear rail being used to linearly guide at least another one of said polishing heads.

20. The polishing apparatus of claim 18 wherein said main polishing structure includes a lead screw connected to a head transport motor for each of said polishing heads, said lead screw and said head transport motor being used to linearly move that polishing head.

21. The polishing apparatus of claim 18 wherein said main polishing structure includes a load cell connected to said head transport motor for at least one of said polishing heads to detect changes in torque for polishing end point detection, and wherein said main polishing structure includes a current sensor connected to a polishing table drive mechanism for at least one of said polishing tables to detect changes in electrical current being used by said polishing table drive mechanism, said load cell being used in conjunction with said current sensor for said polishing end point detection.

22. The polishing apparatus of claim 18 wherein said main polishing structure includes a current sensor connected to a head rotating mechanism for at least one of said polishing heads to detect changes in electrical current being used by said head rotating mechanism, and wherein said main polishing structure includes another current sensor connected to a polishing table drive mechanism for at least one of said polishing tables to detect changes in electrical current being used by said polishing table drive mechanism, said current sensor being used in conjunction with said another current sensor for polishing end point detection.

23. The polishing apparatus of claim 18 wherein said add-on frame structure includes an additional upper mounting plate with at least one additional linear rail mounted on a vertical surface of said additional upper mounting plate, said at least one additional linear rail being aligned with said at least one linear rail of said main frame structure when said add-on polishing structure is attached to said main polishing structure, said at least one additional linear rail being used to linearly guide said additional polishing head.

24. The polishing apparatus of claim 18 wherein said main polishing structure includes a pad conditioner for each of said polishing tables, and wherein a conditioner linear rail is mounted on a bottom surface of said upper mounting plate, said conditioner linear rail being used to linearly guide said pad conditioner.

25. The polishing apparatus of claim 24 wherein said pad conditioner is attached to a mounting plate that has a shape of "⊏", said mounting plate including an upper horizontal portion, a lower horizontal portion and a vertical portion that connects said upper and lower horizontal portions, said mounting plate being used to connect said pad conditioner to said conditioner linear rail.

26. The polishing apparatus of claim 25 further comprising an enclosing structure to enclose said upper mounting plate such that said polishing heads and said pad conditioner are external to said enclosing structure, said enclosing structure including openings to accommodate neck portions of rail grippers for said polishing heads and said upper horizontal portion of said mounting plate, said rail grippers being used to connect said polishing heads to said linear rails.

27. The polishing apparatus of claim 26 wherein at least some of said openings of said enclosing structure are sealed with sealing material, and wherein said neck portions are configured such that each neck portion tapers to a point at both ends so that said openings of said enclosing structure are sealed by said sealing material at said both ends of said neck portions.

28. A polishing apparatus for polishing semiconductor wafers comprising:

a main polishing structure including a first polishing table, a first polishing head and a first load-and-unload station that are operatively coupled to a main frame structure, said first polishing head being operatively coupled to said main frame structure such that said first polishing head can transfer said semiconductor wafers in a linear manner from said first polishing table to said first load-and-unload station using a first linear rail; and an add-on polishing structure including a second polishing table and a second polishing head that are operatively coupled to an add-on frame structure, said second polishing head being operatively coupled to said add-on frame structure such that said second polishing head can transfer said semiconductor wafers in a linear manner from said first load-and-unload station to said second polishing table using at least a second linear rail such that said second polishing head can receive said semiconductor wafers from said first load-and-unload station and polish said semiconductor wafers on said second polishing table, wherein said add-on polishing structure is configured to be attached to said main polishing structure such that said first linear rail and said second linear rail are aligned to form a straightly connected linear rail.

* * * * *